US009570834B2

(12) United States Patent
Underwood et al.

(10) Patent No.: US 9,570,834 B2
(45) Date of Patent: Feb. 14, 2017

(54) ELECTRICAL SOCKET WITH SHUTTER AND RETAINER ARRANGEMENT

(75) Inventors: Geoffrey Paul Underwood, Newport (GB); Mark Thompson, Irvine, CA (US)

(73) Assignee: WUNELLI LIMITED (GB)

( * ) Notice: Subject to any disclaimer, the term of this patent is extended or adjusted under 35 U.S.C. 154(b) by 67 days.

(21) Appl. No.: 14/343,564

(22) PCT Filed: Sep. 7, 2012

(86) PCT No.: PCT/GB2012/052212

§ 371 (c)(1),
(2), (4) Date: Sep. 3, 2014

(87) PCT Pub. No.: WO2013/034928

PCT Pub. Date: Mar. 14, 2013

(65) Prior Publication Data

US 2015/0288089 A1 Oct. 8, 2015

(30) Foreign Application Priority Data

Sep. 9, 2011 (GB) ..... 1115632.0

(51) Int. Cl.
*H01R 13/44* (2006.01)
*H01R 13/453* (2006.01)
(Continued)

(52) U.S. Cl.
CPC ..... *H01R 13/453* (2013.01); *H01R 13/4534* (2013.01); *H01R 13/6683* (2013.01); *H01R 24/78* (2013.01); *H01R 2103/00* (2013.01)

(58) Field of Classification Search
CPC ..... H01R 13/453; H01R 13/6683; H01R 13/4534; H01R 24/78; H01R 2103/00; H01R 13/66
(Continued)

(56) References Cited

U.S. PATENT DOCUMENTS 3,980,372 A 9/1976 Ranzanigo
5,006,075 A 4/1991 Bowden, Jr.
(Continued)

FOREIGN PATENT DOCUMENTS

EP 0615313 9/1994
EP 0654857 2/1998
(Continued)

OTHER PUBLICATIONS

International Search Report and Written Opinion issued in corresponding application No. PCT/GB2012/052212 on Jan. 25, 2013.
(Continued)

*Primary Examiner* — Javaid Nasri
(74) *Attorney, Agent, or Firm* — Whiteford, Taylor & Preston, LLP; Peter J. Davis

(57) ABSTRACT

An electrical socket (1) comprising a carriage (4), the carriage comprising shutter portions, each shutter portion associated with a respective pin receiving opening (5*a*, 5*b*, 5*c*, 5*d*, 5*e*), and the socket comprising a retainer arrangement, and the shutter portions (4*a*, 4*b*), when in a closed condition are inhibited from moving to an open condition by the retainer arrangement, and wherein all the shutter portions are required to be in a released condition from the retainer arrangement in order to allow the shutter portions to be moved to an open condition to allow the plug pins to be inserted therein, and also wherein, if not all of the shutter portions are moved to a released condition, the shutter portions are inhibited from movement to the open condition by way of engagement with the retainer arrangement.

7 Claims, 6 Drawing Sheets

(51) Int. Cl.
*H01R 24/78* (2011.01)
*H01R 13/66* (2006.01)
*H01R 103/00* (2006.01)

(58) Field of Classification Search
USPC ..... 439/135–142, 188
See application file for complete search history.

(56) References Cited

U.S. PATENT DOCUMENTS

| | | | | |
|---|---|---|---|---|
| 5,702,259 | A * | 12/1997 | Lee | H01R 13/4534 439/137 |
| 6,224,401 | B1 | 5/2001 | Yu | |
| 6,776,630 | B1 | 8/2004 | Huang | |
| 6,786,745 | B1 | 9/2004 | Huang | |
| 7,588,447 | B1 | 9/2009 | Ni | |
| 2003/0017731 | A1 | 1/2003 | Huang | |

FOREIGN PATENT DOCUMENTS

| | | |
|---|---|---|
| EP | 1333535 | 12/2004 |
| GB | 691813 | 5/1953 |
| GB | 1210360 | 10/1970 |
| WO | 2007030606 | 3/2007 |

OTHER PUBLICATIONS

Search Report issued by the United Kingdom Intellectual Property Office on Jul. 23, 2012 in corresponding application No. GB1115632.0.
Examination Report issued in corresponding European Application No. 12775533.8 on Jun. 1, 2016.

* cited by examiner

| CONDITION | SENSOR 1 | SENSOR 2 | OUTPUT |
|---|---|---|---|
| PLUG OUT | HIGH | HIGH | LOW |
| ONE PIN IN | HIGH | LOW | LOW |
| PLUG FULLY IN | LOW | LOW | HIGH |

ELECTRICAL SOCKET WITH SHUTTER AND RETAINER ARRANGEMENT

TECHNICAL FIELD

The present invention relates to electrical sockets.

BACKGROUND

Electrical sockets are known which enable the insertion of a plug in order to connect an electrical device to a power supply. In particular, although not exclusively, in relation to passenger transportation, we have devised an improved electrical socket

SUMMARY

According to a first aspect of the invention there is provided an electrical socket comprising a carriage, the carriage comprising shutter portions, each shutter portion associated with a respective pin receiving opening, and the socket comprising a retainer arrangement, and the shutter portions, when in a closed condition are inhibited from moving to an open condition by the retainer arrangement, and wherein all the shutter portions are required to be in a released condition from the retainer arrangement in order to allow the shutter portions to be moved to an open condition to allow the plug pins to be inserted therein, and also wherein, if not all of the shutter portions are moved to a released condition, the shutter portions are inhibited from movement to the open condition by way of engagement with the retainer arrangement.

The retainer arrangement may comprise a respective retainer surface for each shutter portion. In order to adopt a released condition, each shutter portion is required to be moved clear of its respective retainer surface.

Each shutter portion is displaceable in a first direction to the released condition, which direction is substantially perpendicular to a second direction in which each shutter portion is displaceable to the open condition.

The first direction may be substantially parallel to the direction to which a plug pin is insertable into its opening.

The carriage may comprise a connection piece which connects the shutter portions together.

One or some of the shutter portions is/are capable of displacement to the released condition independently of the other shutter/remaining shutter portions such that urging of one or only some of the shutter portions to the released condition does not urge the other shutter portion(s) to the released condition.

The connection piece has flexibility in the first direction to allow the shutter portions to move to the released condition independently of one another.

Each shutter portion may comprise inclined surfaces arranged to contact with respective distal ends of plug pins.

The socket may comprise a resilient biasing arrangement to urge the shutter portion towards the closed condition.

The socket may be arranged for use in a vehicle, such as in an aircraft cabin, in a train or in a bus/coach, but other uses can equally be envisaged.

The retainer arrangement preferably comprises a catch which is immovable with the socket housing.

In a closed condition, the shutter portions preferably inhibit ingress of liquid towards the electrical terminals of the socket.

The socket may be arranged to receive different pin configurations of different plug types. For example, the socket may be capable of receiving the following plug types:

NEMA 1-15—two pin—USA and Japan
NEMA 5-15—three pin—USA
CEE 7/16—two pin—Europe
CEE 7/17—two pin—Europe
BS546—three pin—Kuwait/Qatar
CEE 7/5—two pin—Poland/France/Belgium
CEE 7/4—two pin—Europe
CEE 7/7—Two pin—France/Germany
BS1363—three pin—UK/Ireland/Singapore/Malaysia
SI32—three pin—Israel
AS-3112—three pin—Argentina/Australia/New Zealand
SEV-1011—three pin—Switzerland
SRAF1962/DB—Denmark
CEI23-16—Chile/Italy
BS546—India/South Africa/Pakistan/Hong Kong Openings (for receipt of plug pins) are preferably dimensioned to receive plug pins of different sizes, shapes, configurations and spacings, corresponding to different plug types, and the internal electrical terminals arranged to be brought into electrical contact with the pins of the different plug types. Preferably, the socket arranged to receive both two and three pin plugs. Preferably, the socket comprises three enlarged openings, two of which arranged to receive live plug pins, and a third enlarged opening for a ground pin.

According to a second aspect of the invention there is provided an electrical socket comprising a sensor arrangement to detect whether pins of a plug have been inserted into the socket, the sensor arrangement comprising a radiation emitter and a detector for each of at least two pin-receiving spaces, and a line of sight connecting the emitter and the detector passing through a respective pin receiving space such that insertion of a pin into the pin-receiving space alters the radiation level received by a respective detector, the socket further comprising a signal processor arranged to receive signals from the detectors and determine that a power supply is to be connected to electrical terminals to contact with the pins if the at least two pins are determined as having been inserted into the pin receiving spaces.

The sensor arrangement may be such that on insertion of a pin into the respective pin receiving space, radiation to the respective detector is blocked, or at least reduced, by the presence of the pin.

Preferably the socket comprises two pin-receiving spaces, each provided with a respective sensor arrangement.

The emitter may be an infra-red emitter, but may be any other suitable form of electromagnetic radiation emitter.

The socket preferably comprises a switch which is controlled by the signal processor, the switch arranged to connect an electrical supply to the electrical terminals of the pin-receiving spaces.

Preferably, a pin is required to be inserted into a respective pin-receiving space by at least a predetermined depth in order to affect the level of radiation received by the respective detector.

According to a further aspect of the invention there is provided an electrical socket comprising the features of the first aspect of the invention and the features of the second aspect of the invention.

An electrical socket in accordance with any preceding aspect in which a housing thereof arranged to be mounted to a supporting structure such as a building, a vehicle or an apparatus. The socket housing is preferably arranged to be attached to the supporting structure by way of a releasable (resilient) clip arrangement which holds the socket in position in a socket-receiving recess of the supporting structure, and allows, the socket to be detached by direct manual intervention, or by way of use of a suitable tool, to deflect the clip, and then urging the socket from its position. Alternatively, or in addition, the socket housing may comprise a fixing-receiving formation to allow the socket to be attached to the supporting structure by way of one or more fixings. The socket could be secured in position to the supporting structure by forming a suitably sized recess in the supporting structure, inserting the socket thereinto (and ensuring that the socket is connected to a power supply) and then using suitable fixings (such as screws) with pre-formed openings in the socket housing to hold the socket in position on the supporting structure.

An electrical plug socket as disclosed herein advantageously provides a high level of safety to users.

BRIEF DESCRIPTION OF THE DRAWINGS

Various embodiments of the invention will now be described, by way of example only, with reference to the following drawings in which.

DETAILED DESCRIPTION

Figure 1:
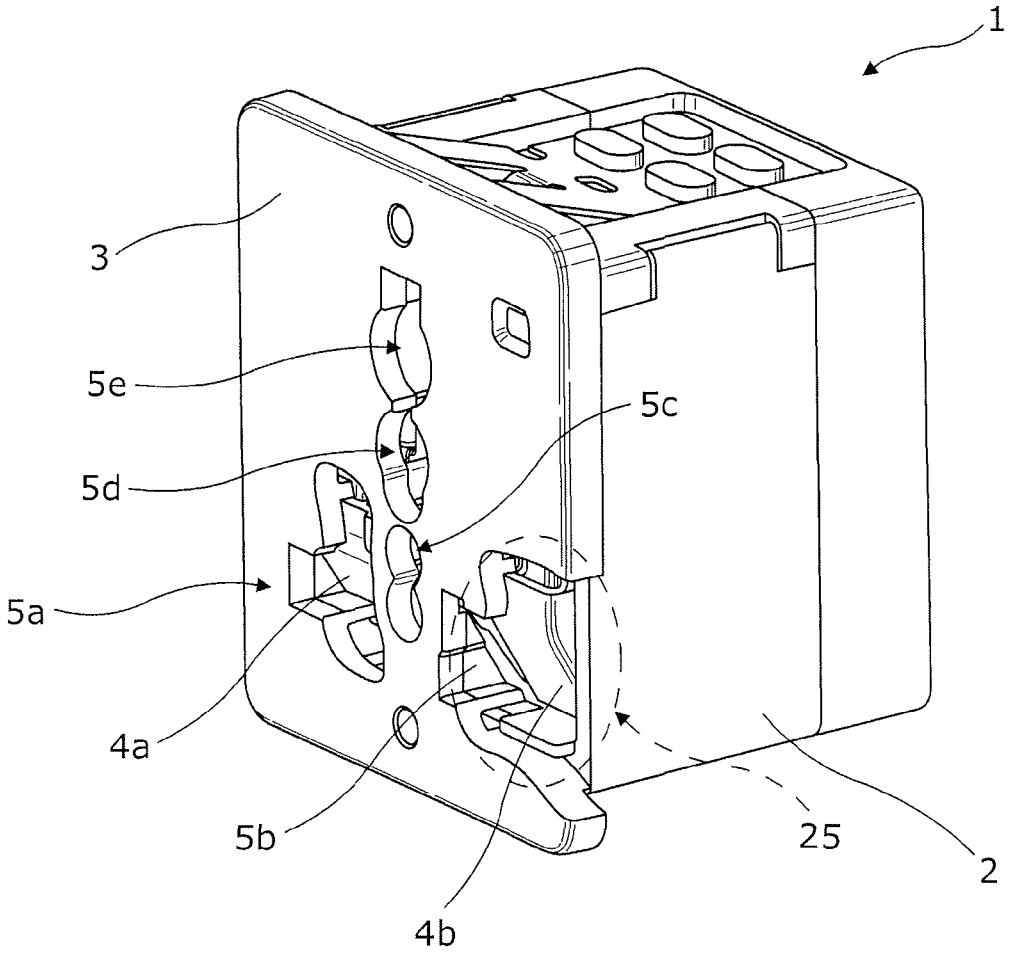
FIG. 1 is a perspective view of an electrical plug socket.

Reference is made initially to FIG. 1 which shows an electrical plug socket 1, or power outlet, comprising a housing 2, a frontal face 3 and a shutter carriage 4, which is contained with the housing 2. The socket comprises electrical terminals for electrical contact with pins of a plug insertable into the socket 1, the plug being connected to an electrically powered apparatus/device. As will be described below, the socket 1 is advantageously such that power is only supplied to the plug if the plug is correctly inserted into the socket 1.

The housing 2 comprises fixing formations, such as a releasable (resilient) clip and/or through-holes for screw fixings, to allow the socket to be attached to a supporting structure such as a building, a wall, a vehicle or equipment. The socket is preferably made of a flame retardant insulate plastic, with the shutter carriage preferably made of polyetherimide.

The frontal face 3 of the socket 1 further comprises pin receiving openings 5*a*, 5*b*, 5*c*, 5*d* and 5*e*. Reference is made in particular to the openings 5*a* and 5*b* which lead to respective pin receiving spaces which contain respective electrical terminals. Each opening 5*a* and 5*b* is arranged to receive a respective pin of the plug. The openings 5*a* and 5*b* serve as openings for receipt of the 'live' pins of a plug, and the openings 5*c*, 5*d* and 5*e* serve as openings for ground connections.

Figures 2, 3, 4, 5, 6:
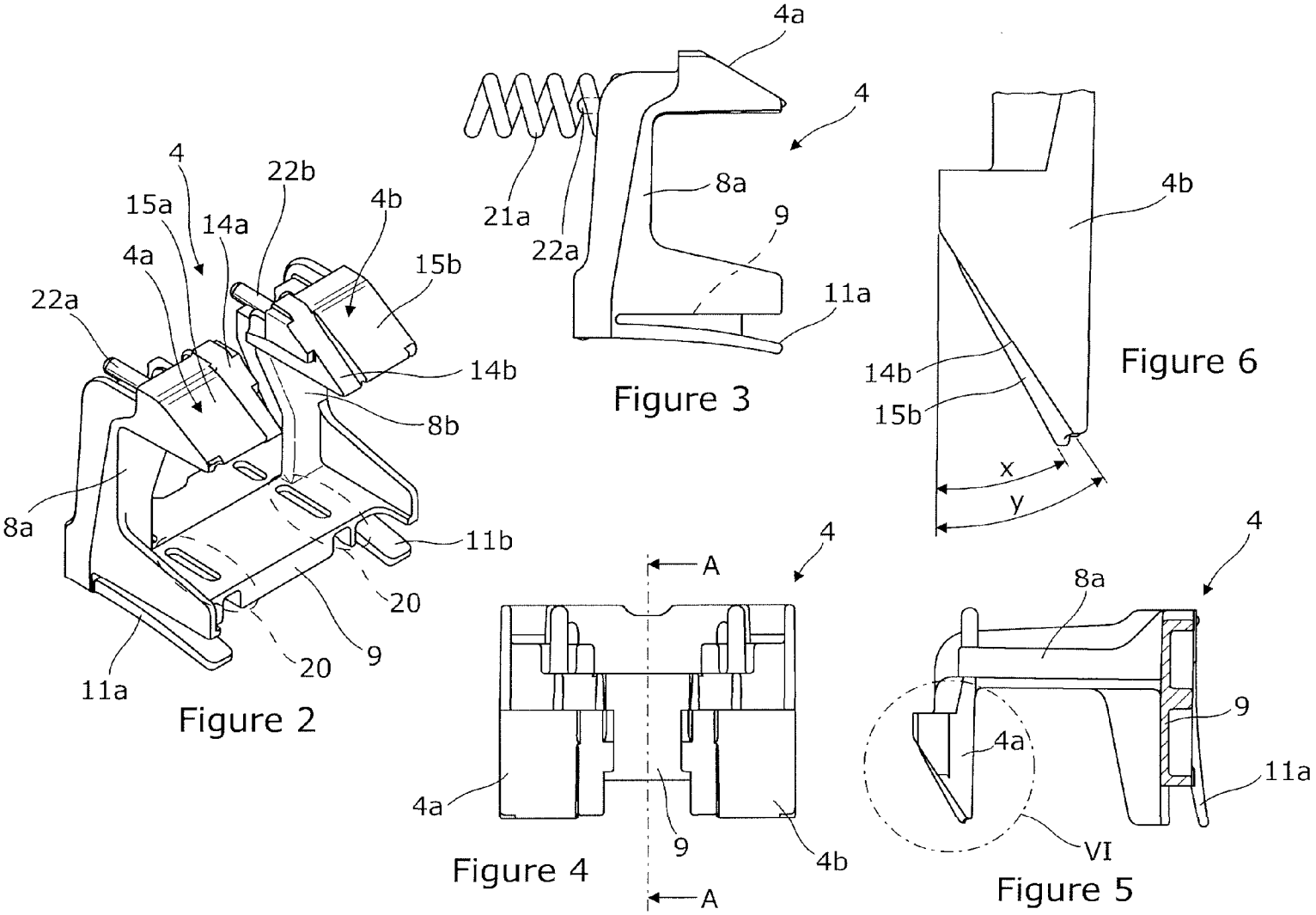
FIG. 2 is a perspective view of a shutter carriage of an electrical plug socket.
FIG. 3 is a side view of the shutter carriage of FIG. 2.
FIG. 4 is an end view the shutter carriage of FIGS. 2 and 3.
FIG. 5 is a section on A-A of the shutter carriage of FIG. 4.
FIG. 6 is an enlarged view of a portion of the shutter carriage of FIG. 5.

Without any plug inserted into the socket, access to the respective pin receiving spaces is blocked by shutters 4*a* and 4*b* of the shutter carriage. (It will be appreciated that the view shown in FIG. 1 shows a cutaway section 25 which is included for illustration purposes only, and would not be present in the actual socket 1.) With reference now to FIG. 2, features of the shutter carriage are now described. The shutter carriage 4 comprises the two shutters 4*a* and 4*b*, each provided on a respective limb 8*a* and 8*b*, respectively. The limbs 8*a* and 8*b* stand up from a connector piece 9, which connects the two limbs. Each shutter 4*a* and 4*b* is provided with a double inclined surface in which two adjacent inclined surfaces 14*a* and 15*a*, and, 14*b* and 15*b*, are provided. As can be seen in FIG. 6, each surface is set a different incline. For example, the surface 14*b* may be an angle (to the vertical) of 35 degrees (as indicated by angle y), whereas, the inclined surface 15*b* may be at an angle of 30 degrees (as indicated by angle x). Each of the inclined surfaces is arranged to engage with a distal end of a respective plug pin during insertion of the plug into the socket.

Rearwardly of each of the shutters, and behind the connector piece 9, there is provided a leaf spring 11*a* and 11*b* which is arranged engage with a rear wall of the housing 2 of the socket 1 so as to urge the respective shutter towards the respective opening.

Towards the junction between each limb and the connector piece, the connector piece comprises a weakened portion 20 which, as will be described below, independent rearward movement of one shutter, independently of the other.

An upper surface of the shutter carriage 4 is provided with return springs 21*a* and 21*b*, one above each shutter. The springs are located by respective posts 22*a* and 22*b*, at one end, and are located at the opposite ends thereof by suitable formations provided in a roof portion of the housing 2. In use, the springs 21 serve to urge the carriage 4, and therefore the shutters, downwardly towards the base of the housing 2, and in particular, towards the shutters being in the closed condition.

Figure 9:
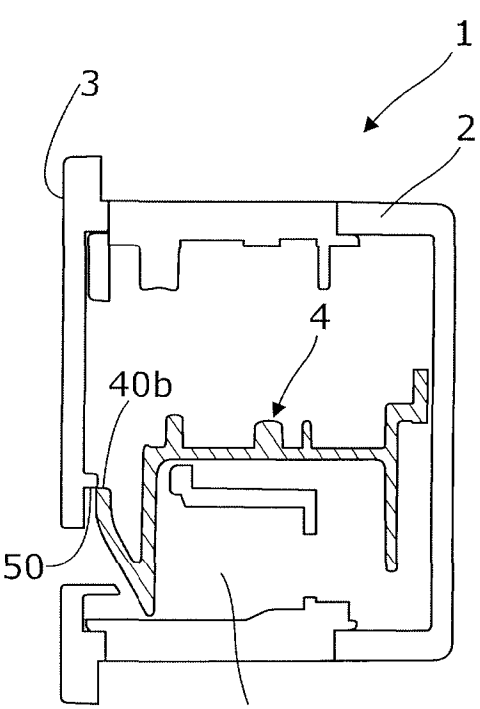
FIG. 9 is a section on D-D of the socket shown in FIG. 7.
Figure 8:
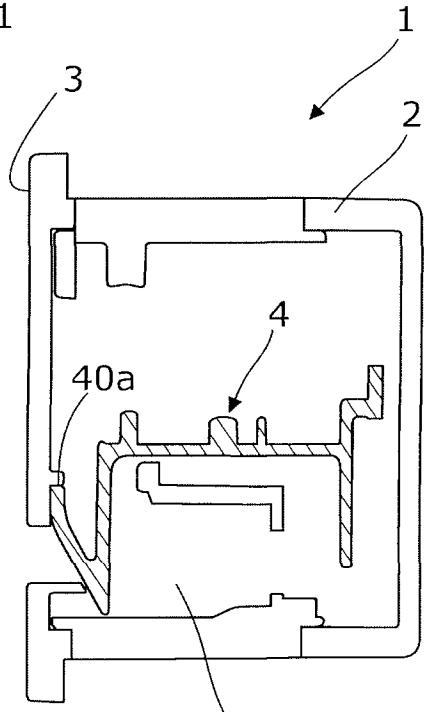
FIG. 8 is a section on C-C of the socket shown in FIG. 7.
Figure 7:
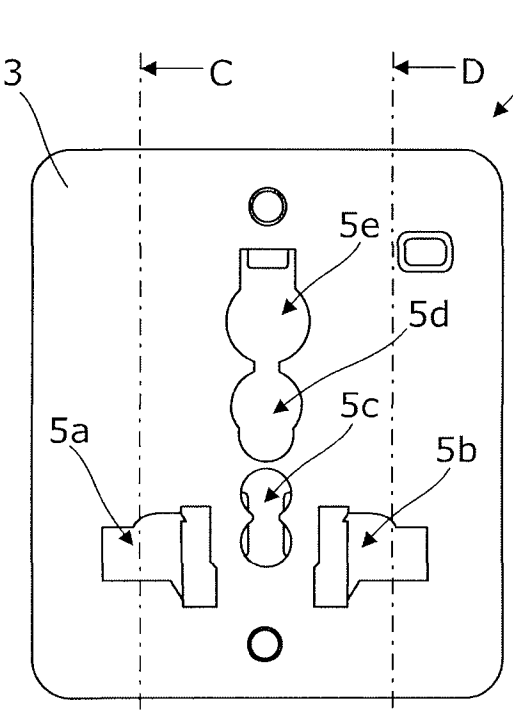
FIG. 7 is a front elevation of the electrical plug socket of FIG. 1.

Reference is now made to FIGS. 7, 8 and 9 to describe the feature of the socket that the pins of the plug must be inserted into both openings 5*a* and 5*b* in order to allow the pins to enter pin-receiving spaces 30*a* and 30*b*, and thereby make contact with the electrical terminals. In the closed condition, in which the shutters block access to the pin-receiving spaces, an upper surface of each shutter, is located below a respective retainer surface 50, which serves as a catch which extends into the interior space of the housing. In this condition, the retainer surface 50 prevents the shutters from moving upwardly to open the openings.

Figure 11:
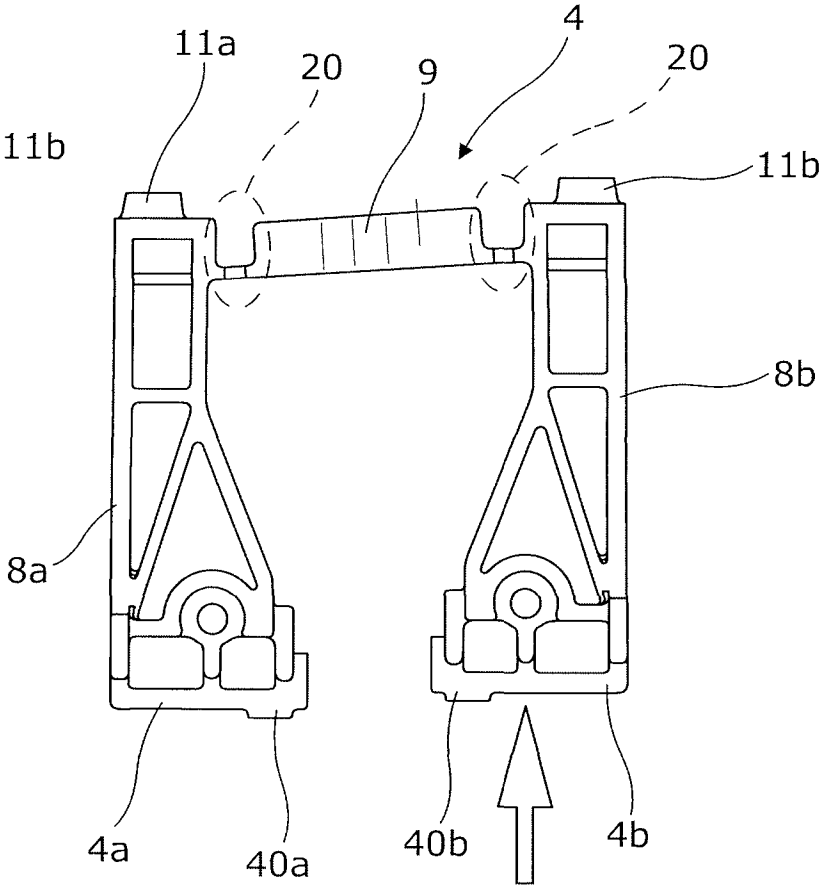
FIG. 11 is a further plan view of the shutter carriage of FIG. 2.
Figure 10:
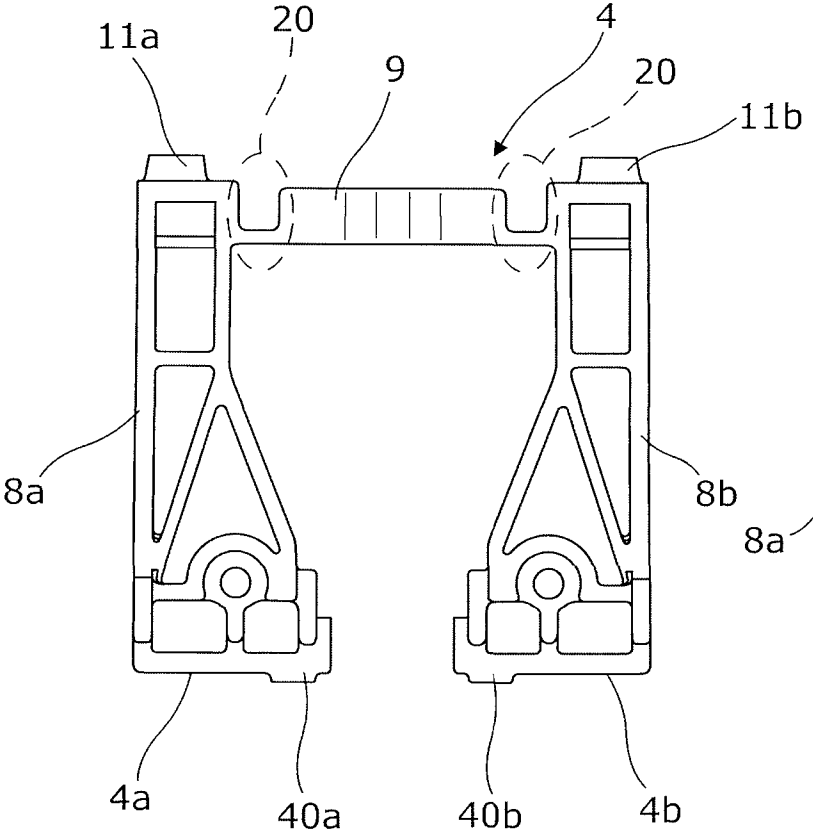
FIG. 10 is a plan view of the shutter carriage of FIG. 2.

FIG. 10 shows the shutter carriage in the closed condition. Should a user urge an object, such as a foreign object or incorrectly attempt to urge a single plug pin into one pin receiving space only, neither shutter will be moved to the open condition. In the example illustrated, as best seen in FIG. 11, a user applies a force to the shutter 4*b*, but not to the shutter 4*a*, the shutter 4*b* (and the associated limb 8*a*) will be moved rearwardly away from the opening 5*a*. As can be seen in FIGS. 8 and 9, the surface 40*b* of the shutter 4*b* is moved clear of the retainer surface 50, whereas the surface 40*a* of the shutter 4*a* remains underneath the retainer surface 50. As best seen in FIG. 11, due to the weakened portions 20 in the connector piece 9, only the limb 8*b* moves, whereas the limb 8*a* remains in position. Because the limb 8*a* (and therefore the surface 40*a*) is not displaced, the carriage as a whole cannot to moved from the closed position, despite the resultant upward force applied to the shutter carriage 4 caused by the force applied by the user to the shutter 4*a*.

In the situation that a plug is correctly inserted into the openings of the socket 1, a respective pin is urged against both the shutter 4*a* and the shutter 4*b* and the respective surfaces 40 are both urged clear of the respective portions of the retainer surface 50. This means that on continued application of force to the shutters by the plug pins, the leaf springs 11*a* and 11*b*, are urged against the rear wall of the housing 2, and the inclined surfaces 14*a*/15*a* and 14*b*/15*b* of the shutters create an upward force being applied to the carriage so as to urge the shutter carriage upwardly and the shutters being urged away from their respective openings towards an open condition.

On the plug pins entering the pin-receiving spaces 30*a* and 30*b*, the pins contact with the respective electrical terminals therein. The terminals are of the type which are resiliently biased inwardly of the pin-receiving spaces such that each plug pin has to deflect the terminal in order for the pin to be correctly received within the respective space. This then ensures that the terminal is resiliently biased against the plug pin to ensure electrical contact between the pin and the terminal. With the pins in the 'home' position, the shutter carriage is prevented from returning to the closed position. However, when the user removes the plug from the socket, the return springs 21 and the leaf springs 11, will resiliently urge the shutters to the closed condition.

Figure 12:
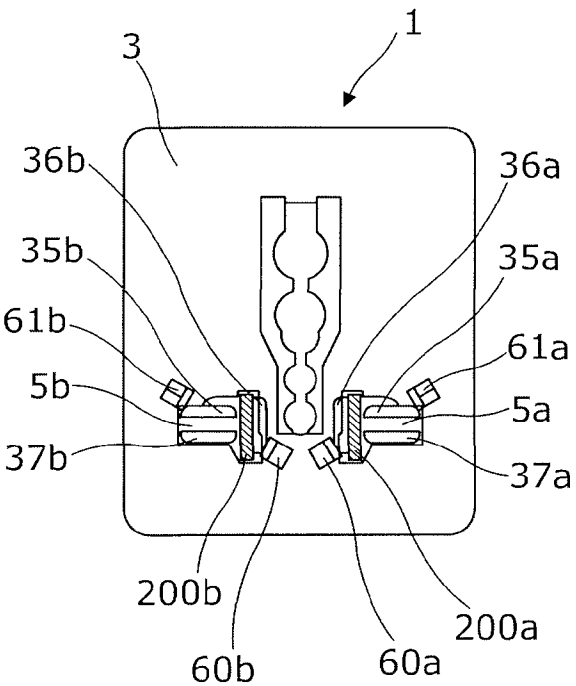
FIG. 12 is an internal view of the socket of FIG. 1.

As will be described below, the socket 1 comprises a sensor arrangement to determine when both pins are in the respective home positions, and on such determination, to connect the electrical terminals to a power supply. Reference is made to FIG. 12, which shows an internal view (ie from within the socket 1 towards the openings) of such a sensor arrangement which comprises an infrared emitter 60*a* and an infrared detector 61*a*, with a line of sight extending through the pin receiving space 30*a*, and the sensor arrangement comprising an infrared emitter 60*b* and an infrared detector 61*b*, with a line of sight extending through the pin-receiving space 30*b*. The sensor arrangement is located rearwardly of the socket 1. As can be seen from the circuit of FIG. 15, each of the emitters 61*a* and 61*b*, is powered by an infrared LED 161 which emits radiation into a light guide 165, which suitably reflects and guides the received radiation to generate emitted radiation for each emitter. The emitter/detector pair 60*a* and 61*a* are associated with live pin terminals and the emitter/detector pair 60*b* and 61*b* are associated with neutral pin terminals. The circuit includes an LED driver 167 which powers the LED 161. Signals from the detectors 60*a* and 60*b* are received by a signal conditioner 170 in which conditioned signals are sent to a logic circuitry 171.

The socket 1 further includes a power interface 180 which is connected to the circuit 150. The interface includes a switch to selectively connect and disconnect a power supply to the live and neutral terminals of the socket 1, dependent on whether the logic circuitry 171 determines that both pins are correctly and fully inserted into their respective pin-receiving spaces.

Figures 15, 16:
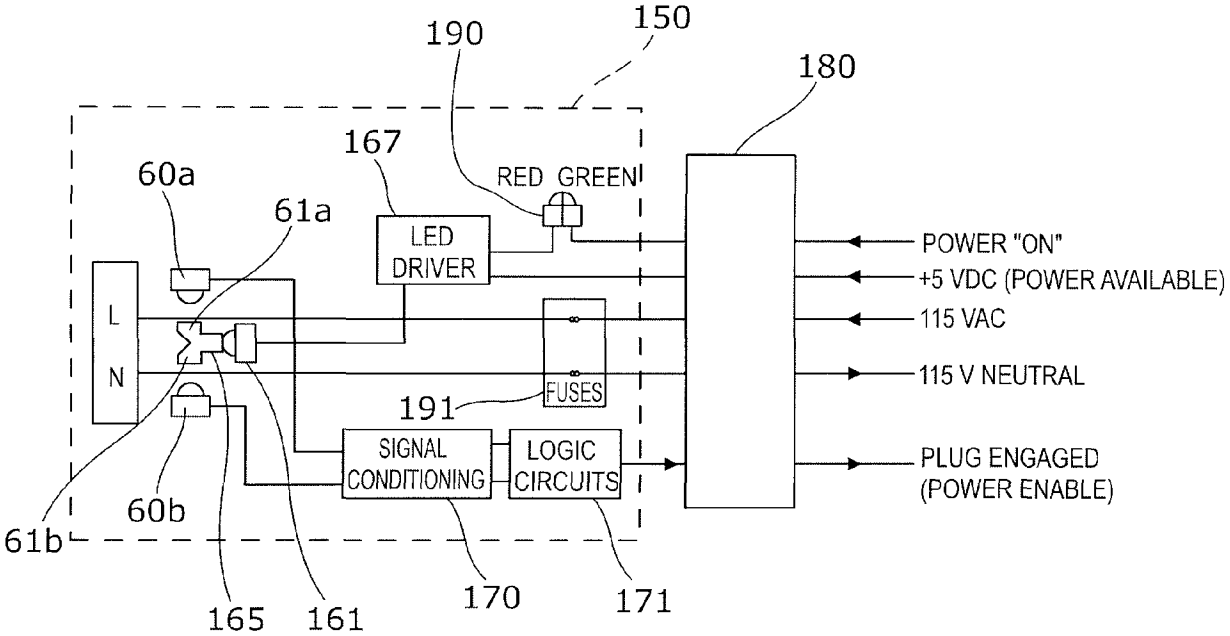
FIG. 15 is circuit block diagram of a control circuit of the socket of FIG. 1.
FIG. 16 is a logic table related to the functionality implemented by the control circuit of FIG. 15.

The logic circuitry 171 determines an output according to the logic table shown in FIG. 16, in which 'Sensor 1' and 'Sensor 2' are indicative of the detectors 60*a* and 60*b* respectively. When the output is HIGH, a signal is sent to the switch of the interface 180 to connect the power supply to the terminals, otherwise, the switch has a default condition of disconnecting the power supply to the terminals.

The circuit 150 also comprises fuses 191, with one fuse for each of the live and neutral terminals.

The circuit further comprises a status indicator 190, which is illuminated green when the power supply is connected, otherwise it is illuminates red. The indicator is connected to both the LED driver 167 and to the interface 180 (and in particular is responsive to the status of the switch within the interface 180). It will be appreciated that the voltage values given in FIG. 15 are by way of example only.

Returning to FIG. 12, the socket 1 comprises three resiliently biased electrical terminals (of the type mentioned above) associated with each of the pin-receiving spaces 30*a* and 30*b*, namely terminals 35*a*, 36*a* and 37*a* associated with the pin-receiving space 30*a*, and the terminals 35*b*, 36*b* and 37*b* associated with the pin-receiving space 30*b*. In FIG. 12, two pins 200*a* and 200*b* are inserted into the pin-receiving spaces 30*a* and 30*b* respectively. The pins are in electrical contact with the terminals 36*a* and 36*b* respectively. In this example, the pins are attached to a plug of the type NEMA (National Electrical Manufacturers Association) wherein the pins are in the form of two blades. The distal end portions of each pin are such as to block the radiation emitted from the emitters from reaching the associated detectors. This will result in the signal emitted from each detector as being LOW, and therefore, the power supply is connected to the pins in accordance with the predetermined logic condition. When the plug is removed from the socket 1, the radiation will again reach the detectors and so a HIGH signal is sent from each detector to the logic circuitry 171. In that instance, the output signal from the logic circuitry is operative to cause the switch in the interface 180 to disconnect the power supply.

Figure 13:
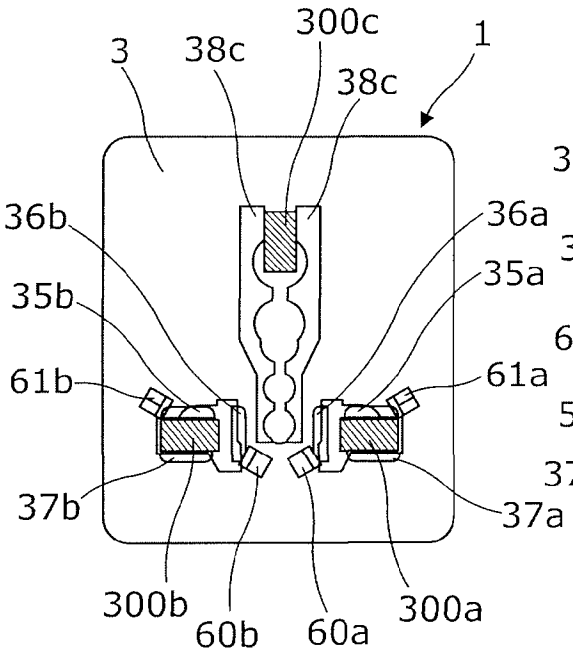
FIG. 13 is an internal view of the socket of FIG. 1.

FIG. 13 shows a different type inserted into the socket 1. In this instance, the plug is of a three pin type used in the United Kingdom, comprising three pins 300*a*, 300*b* and 300*c*. The pins 300*a* and 300*b*, once inserted into the socket, are in electrical connection with the electrical terminals 37*a* and 37*b*. Similarly as above, the presence of the pins blocks radiation from reaching the associated detectors and so the power supply is connected to the terminals. A third pin 300*c*, is in electrical connection with a pair of electrical terminals 38*c*, which serve as an earthing connection for the pin 300*c*.

Figure 14:
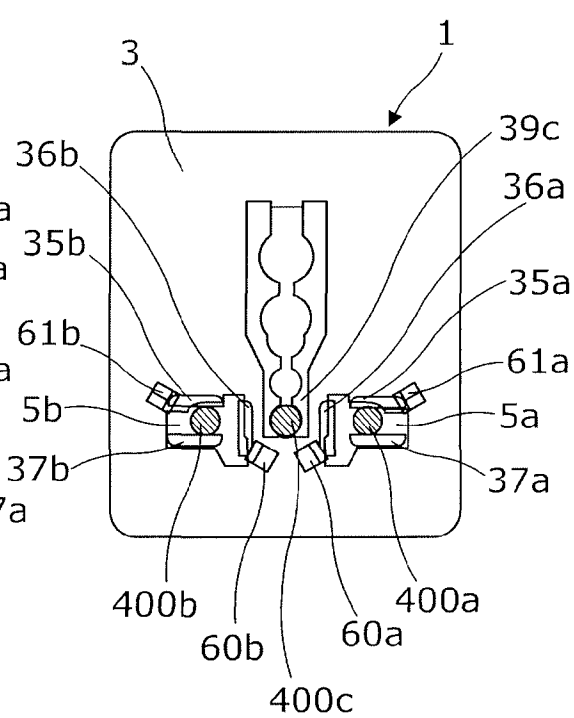
FIG. 14 is an internal view of the socket of FIG. 1.

FIG. 14 shows a further type of plug inserted into the socket 1, which comprises three rounded pins 400*a*, 400*b* and 400*c*. The pins 400*a* and 400*b* are in electrical connection with the electrical terminals 36*a* and 36*b* respectively. Similarly as above, with the pins fully and correctly inserted into the socket, the radiation is prevented from reaching the detectors and so power is supplied to the terminals. The third pin 400*c* is in electrical contact with a terminal 39*c* to serve as an earthing connection.

The above socket 1, finds particular, although not exclusive, application in the field of aircraft power supply, in which the sockets are provided adjacent to passenger seating in the aircraft cabin, to enable passengers to power their electrical devices. Advantageously, the socket 1 is capable of receiving the majority of different electrical plug types used in different regions of the world, thus obviating the need for the passenger to use a plug adapter. Further advantageously, the various components of the socket are arranged in a spatially efficient manner, thus leading to the socket being of compact dimensions making it particularly useful for space-limited environments such as passenger transportation.

When the socket is not in use, the shutters 4*a* and 4*b* being in the closed condition ensure that ingress of dust and fibres into the socket is prevented, thus ensuring that dust does not reside on any of the electrical terminals to ensure optimal electrical connection. The shutters 4*a* and 4*b* when in the closed condition, also prevent the ingress of liquid into the socket, forming a liquid barrier. When in the closed condition, the shutters prevent any background infrared (from a source external to the interior space of the socket) entering the socket and causing accidental trip.

In a passenger transportation environment, the socket 1 affords a high level of safety to passengers due to passenger, such as an infant, attempting to insert a metallic or other electrically conductive object into the socket. Since passengers could be spending long periods of time in the seat, there is an increased likelihood of a foreign object being attempted to be inserted into the socket. It will be appreciated that the socket would operate in combination with a suitable power supply that has an interlock input control line to further enhance safety levels.

Although mention has been made of application to aircraft, the socket could also be used in other forms of passenger transportation such as buses, coaches and trains.

In one embodiment of the invention, in addition to the predetermined output from the logic circuitry 171 being required to connect the power supply, it may also be required that an electrical loading check in relation to a circuit including the pins is also performed to ensure that the pins are present before supply power.

The invention claimed is:

1. An electrical socket comprising a carriage, the carriage comprising shutter portions, each shutter portion associated with a respective pin receiving opening, and the socket comprising a retainer arrangement, and the shutter portions, when in a closed condition are inhibited from moving to an open condition by the retainer arrangement, and wherein all the shutter portions are required to be in a released condition from the retainer arrangement in order to allow the shutter portions to be moved to an open condition to allow the plug pins to be inserted therein, and also wherein, if not all of the shutter portions are moved to a released condition, the shutter portions are inhibited from movement to the open condition by way of engagement with the retainer arrangement, wherein each shutter portion is displaceable in a first direction to the released condition, which direction is substantially perpendicular to a second direction in which each shutter portion is displaceable to the open condition, and the carriage comprises a connection piece which connects the shutter portions together, and the connection piece has flexibility in the first direction to allow the shutter portions to move to the released condition independently of one another.

2. An electrical socket as claimed in claim 1 in which the retainer arrangement comprises a respective retainer surface for each shutter portion.

3. An electrical socket as claimed claim 1 in which the retainer arrangement comprises a catch which is immovable with the socket housing.

4. An electrical socket as claimed in claim 1 in which the first direction is substantially parallel to the direction to which a plug pin is insertable into its opening.

5. An electrical socket as claimed in claim 1 in which the socket comprises a resilient biasing arrangement to urge the shutter portion towards the closed condition.

6. An electrical socket as claimed in claim 1 in which one or some of the shutter portions is/are capable of displacement to the released condition independently of the other shutter/remaining shutter portions such that urging of one or only some of the shutter portions to the released condition does not urge the other shutter portion(s) to the released condition.

7. An electrical socket as claimed in claim 1 in which each shutter portion comprises inclined surfaces arranged to contact with respective distal ends of plug pins.

* * * * *